US008864014B2

(12) United States Patent
Keefe

(10) Patent No.: US 8,864,014 B2
(45) Date of Patent: Oct. 21, 2014

(54) DISPLAY TRAY WITH ADJUSTABLE COMPARTMENTS

(75) Inventor: Walter D. Keefe, Carol Stream, IL (US)

(73) Assignee: International Paper Co., Memphis, TN (US)

( * ) Notice: Subject to any disclaimer, the term of this patent is extended or adjusted under 35 U.S.C. 154(b) by 321 days.

(21) Appl. No.: 13/253,449

(22) Filed: Oct. 5, 2011

(65) Prior Publication Data

US 2013/0087476 A1 Apr. 11, 2013

(51) Int. Cl.

| | |
|---|---|
| ***B65D 5/20*** | (2006.01) |
| ***B65D 77/04*** | (2006.01) |
| ***B65D 5/00*** | (2006.01) |
| ***B65D 5/50*** | (2006.01) |
| ***B65D 5/48*** | (2006.01) |

(52) U.S. Cl.

CPC ..... *B65D 77/04* (2013.01); *B65D 5/001* (2013.01); *B65D 5/5023* (2013.01); *B65D 5/48002* (2013.01); *B65D 2577/043* (2013.01)

USPC ..... 229/120.17; 229/164; 229/167; 229/173

(58) Field of Classification Search

USPC ..... 229/120.13, 120.17, 120.18, 172; 206/557, 561, 565, 740, 745, 748, 784

See application file for complete search history.

(56) References Cited

U.S. PATENT DOCUMENTS

| | | | | |
|---|---|---|---|---|
| 1,930,236 | A | 10/1933 | Fox | |
| 2,089,067 | A * | 8/1937 | Myers | 229/120.17 |
| 2,711,819 | A * | 6/1955 | Lugt, Jr. | 206/561 |
| 2,833,458 | A * | 5/1958 | Toensmeier | 206/562 |
| 3,099,380 | A * | 7/1963 | Nathan | 229/120.17 |
| 4,034,908 | A * | 7/1977 | Forbes et al. | 229/120.18 |
| 4,111,299 | A * | 9/1978 | Taub | 206/564 |
| 4,116,330 | A * | 9/1978 | Ellis | 229/120.17 |
| 4,991,712 | A * | 2/1991 | Wagner | 206/561 |
| 5,335,845 | A * | 8/1994 | Liu | 229/120.18 |
| 5,839,650 | A | 11/1998 | Sheffer | |
| 5,971,265 | A * | 10/1999 | Collins | 229/120.13 |
| 6,059,180 | A * | 5/2000 | Collins | 229/120.13 |
| 6,547,126 | B2 * | 4/2003 | Freiborg et al. | 229/120.17 |
| 7,708,187 | B2 * | 5/2010 | Keefe et al. | 229/167 |
| 2008/0078822 | A1 * | 4/2008 | Keefe et al. | 229/167 |
| 2009/0326707 | A1 | 12/2009 | Mattila | |

FOREIGN PATENT DOCUMENTS

| | | |
|---|---|---|
| FR | 2761961 | 10/1998 |
| GB | 393098 | 6/1933 |
| GB | 1430388 | 3/1976 |

* cited by examiner

*Primary Examiner* — Gary Elkins

(74) *Attorney, Agent, or Firm* — Matthew M. Eslami

(57) ABSTRACT

The present invention is directed to a shipping and display tray a having a bottom wall, a front wall, a back wall, and a pair of opposed side walls foldably joined with one another for holding different products contained therein in an upright position at a point of sale. The shipping and display tray comprising a one-piece shallow tray having a plurality of different sizes of compartments each of which contains a different product size and count therein. Each of the plurality of different sizes of compartments includes an adjustable buffer configured to change the size of the compartment and to accommodate the different product size and count while maintaining a fixed perimeter or outside dimension of the one-piece shallow tray.

12 Claims, 5 Drawing Sheets

DISPLAY TRAY WITH ADJUSTABLE COMPARTMENTS

FIELD OF THE INVENTION

This invention relates generally to a shipping and display container, constructed from a unitary paperboard blank for holding a variety of articles and more particularly, to a shipping and display tray having a plurality of compartments of different sizes that is easily assembled and reduces the amount of paperboard typically used in similar packages.

BACKGROUND OF THE INVENTION

Many products for sale to the public are placed in a primary package that is designed for display at the point of sale. One common practice is to place a quantity of the primary packages in a secondary container for shipping. The retailer must then remove the primary packages from the secondary container and hang them from a hook or place them in another container or on a costly permanent plastic or metal display fixture with spring loaded attachments. This solution is labor intensive and costly to the retailer.

To overcome this problem, packages have been designed that are used for both shipping the primary packages and then displaying them at the point of sale. These packages are especially convenient for the retailer, since it is not necessary for the retailer to remove the articles from a bulk shipping container.

One conventional container or tray for both shipping articles and then displaying them with maximum visual exposure at a point of sale comprises a tray having a smooth bottom wall and relatively narrow upstanding side walls. The articles are supported on the bottom wall and preferably extend above the side walls. For shipping, a cover is optionally placed over the tray loaded with articles or the loaded tray is placed in an outer shipping container to form a shipping package. When the shipping package reaches its destination the tray loaded with articles is removed from the shipping container and placed on a shelf or other surface for display and sale of the items supported in the tray.

Shipping and retail display trays having means for improvising access to the product are known in the art. However, the prior art retail display trays fail to provide a display tray formed from an integral flat piece of sheet material capable of receiving multiple of products in different sizes of compartments.

Therefore, it is desirable to have shipping and display tray that supports and displays different articles for optimum visibility at a point of sale without the need for separate inserts or excess material, thereby minimizing the complexity and cost of such display trays.

SUMMARY OF THE INVENTION

Some of the principle advantages of the present invention of shipping and display tray are: (1) each compartment size has adjustable buffers and dividers to accommodate the preferred product size and count while still maintaining the desired outside dimensions of the tray to be fixed; obtaining certain tray outside dimensions allows for almost perfect utilization of the space for pallet, truck and shelf fitments; (2) desired product counts are essential for marketing guidelines; (3) a one piece display tray structure allows for three different products packaged in the same tray that traditionally are packaged in three separate trays or containers or a single tray that need multiple pieces of dividers and inserts to assure proper fitment; (4) built-in stacking shoulders and dividers allows for easy stackability and prevents nesting of the trays from one layer to the next; and (5) the display tray is die-cut, folded and glued on standard box plant converting equipment.

Other advantages of the present invention are that the corrugated paperboard tray is die-cut, folded and glued on standard box plant converting equipment. The tray is designed to provide: a one-piece structure with adjustable buffer compartments and dividers that forms three different compartments for three different products with desired product size and count while simultaneously allowing for the optimum display tray outside dimensions to maximize the cube efficiencies for pallet, truck and shelf fitments. Further, buffer compartments may be exaggerated to account for small product counts when marketing requires certain product counts per display tray, shelf or pallet. Pre-glued panels allow for easy display tray assembly verses more labor intensive non-pre-glued trays; the pre-glued back buffer panels provide three varying compartments depths that are formed during one fold sequence in the display tray assembly. Additionally, the dividers and adjustable buffers prevent nesting of stacked display trays.

Accordingly, one aspect of the present invention is directed to a shipping and display tray a having a bottom wall, a front wall, a back wall, and a pair of opposed side walls foldably joined with one another for holding different products contained therein in an upright position at a point of sale. The shipping and display tray is made of corrugated paperboard and is defined by a one-piece shallow tray having a plurality of different sizes of compartments each of which contains a different product size and count therein. Each of the plurality of different sizes of compartments includes an adjustable buffer configured to change the size of the compartment and to accommodate the different product size and count while maintaining a fixed perimeter or outside dimension of the one-piece shallow tray. The adjustable buffer is defined by three adjustable buffers each of which having a different size. The fixed perimeter or outside dimension of the display tray maximizes the cube efficiencies for pallet, truck and shelf fitments. The one-piece shallow tray is divided by two partitions to form three different sizes of compartments. The two partitions are positioned parallel to one another and having a height that is substantially the same as heights of the opposed side walls. Each of the pair of opposed side walls is defined by two side walls bridging one another. The two side walls forms a shoulder that permit easy stackability and prevent nesting of display trays onto one another.

Another aspect of the present invention is directed to a shipping and display tray comprising a bottom wall, a front wall, a back wall, and a pair of opposed side walls foldably joined with one another to form a one-piece shallow tray. The one-piece shallow tray comprises a plurality of adjustable buffers foldably extend from the back wall. A plurality of partitions foldably extend from the opposed side wall and foldably engaged with the plurality of the adjustable buffers to form a plurality of different sizes of compartments each of which being used to accommodate a different product size and count while maintaining a fixed perimeter or outside dimension of the one-piece shallow tray. The plurality of partitions includes two partitions each of which integrally extend from the respective opposed side walls.

One further aspect of the present invention is directed to a blank for making a shipping and display tray for holding different products contained therein in an upright position at a point of sale. The blank comprises a rectangularly shaped bottom wall panel having opposite end edges and opposite side edges. A side wall panel is foldably joined to each of the opposite side edges wherein the side wall panel is foldably joined to another side wall panel and a partition panel. A front wall panel is foldably joined to one of the opposite end edges of the bottom wall panel and the front or bumper wall panel includes two end flaps. A back wall panel is foldably joined to other opposite end edges of the bottom wall panel wherein adjustable buffer panels is foldably joined to one longitudinal edge of the back wall. The blank is folded longitudinally in half along a fold line to one edge of a glue panel to the bottom wall panel along glue areas.

BRIEF DESCRIPTION OF THE DRAWINGS

A full understanding of the invention can be gained from the following description of the preferred embodiments when read in conjunction with the accompanying drawings in which.

DETAIL DESCRIPTION OF THE INVENTION

Figure 1:
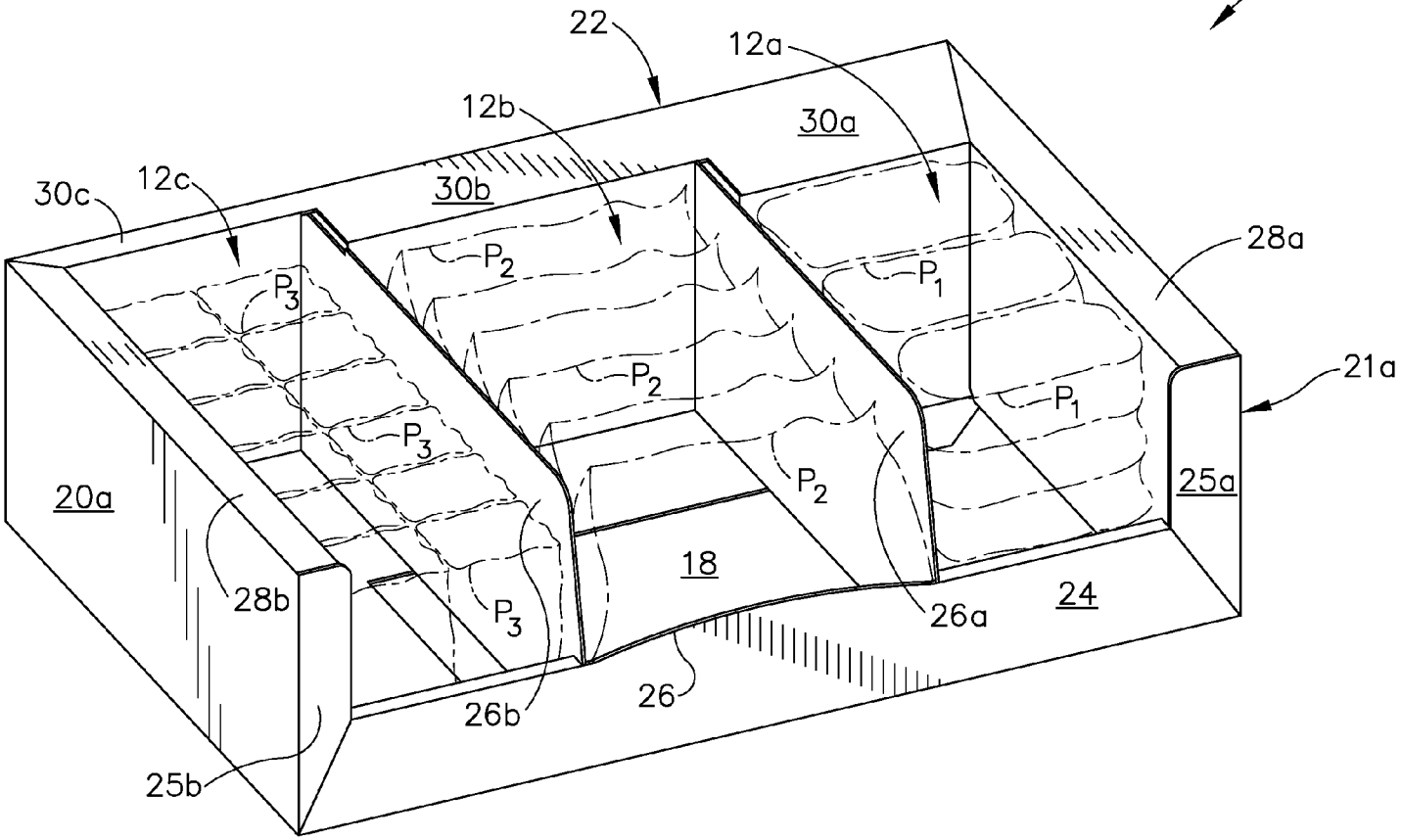
FIG. 1 is a top perspective view of shipping and display tray having three different sizes of compartments loaded with different products therein in accordance to the preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same or those elements are in the unfolded position. In addition, the phrase "adjustable buffer" throughout the specification means that by using different blank (B), the dimension of buffer can be changed from one single blank (B) to another the same single blank (B).

FIG. 1 is a top perspective view of shipping and display tray 10 having three different sizes of compartments 12*a*, 12*b*, and 12*c* loaded with three different products P1, P2, and P3 therein in accordance to a preferred embodiment of the invention. The display tray 10 includes a bottom wall 18, a pair of opposed double side walls 20*a*, 20*b*; 21*a*, 21*b*, a back wall 22 and a bumper or front wall 24. In the particular example shown, the bumper or front wall 24 has much less height than the back wall 22 to enhance exposure of the plurality of products P1, P2, and P3 in the display tray 10. The front or bumper wall 24 is also used to partially prevent products from falling out of the display tray 10 and is also used to provide a place for application of the indicia and/or advertising label. The front or bumper wall 24 include an optional extend upwardly raised front 26 formed from the free edge thereof to enhance the surface area of the bumper wall 24 for printing indicia and the like. The bumper wall 24 is embraced by two front panels 25*a*, 25*b* that form a U-shaped front for the display tray 10. Two spaced apart, partitions or dividers 26*a*, 26*b* are foldably positioned in the display tray 10 to form the aforementioned three different sizes of compartments 12*a*, 12*b*, and 12*c*. The two partitions or dividers 26*a*, 26*b* are configured to rest on the bottom wall 18. Each of the partitions or dividers 26*a*, 26*b* is generally rectangular in shape and has a height that is substantially the same as the height of the double side walls 20*a*, 20*b* and 21*a*, 21*b*. The display tray 10 also includes shoulders 28*a*, 28*b* that permits for easy stackability and prevents nesting of the display trays onto one another when they stacked on one another. The top surfaces of each adjustable buffer 30*a*, 30*b*, and 30*c* also acts as shoulders for the display tray 10 as will be discussed in greater detail hereinafter. It should be noted that the three different sizes of compartments 12*a*, 12*b*, and 12*c* accommodate the products P1, P2, P3 size and count while still maintaining a fixed outside dimension or perimeter of the display tray. Obtaining certain display tray outside dimension substantially maximize the utilization of the space for pallet, truck and/or shelf fitments.

Figure 2:
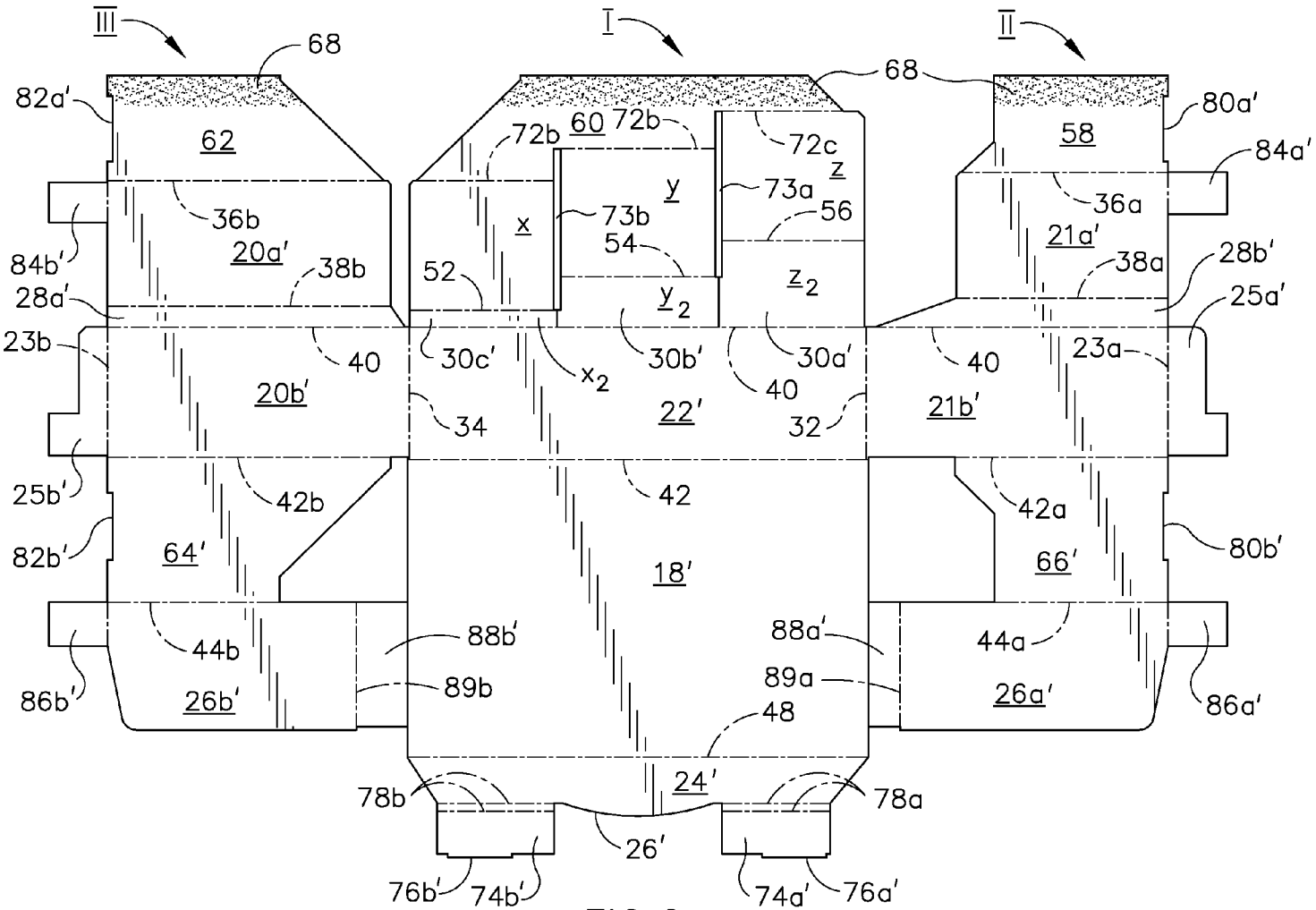
FIG. 2 is a plan view of a cut and scored paperboard blank B for forming the display tray shown in FIG. 1.
Figure 4:
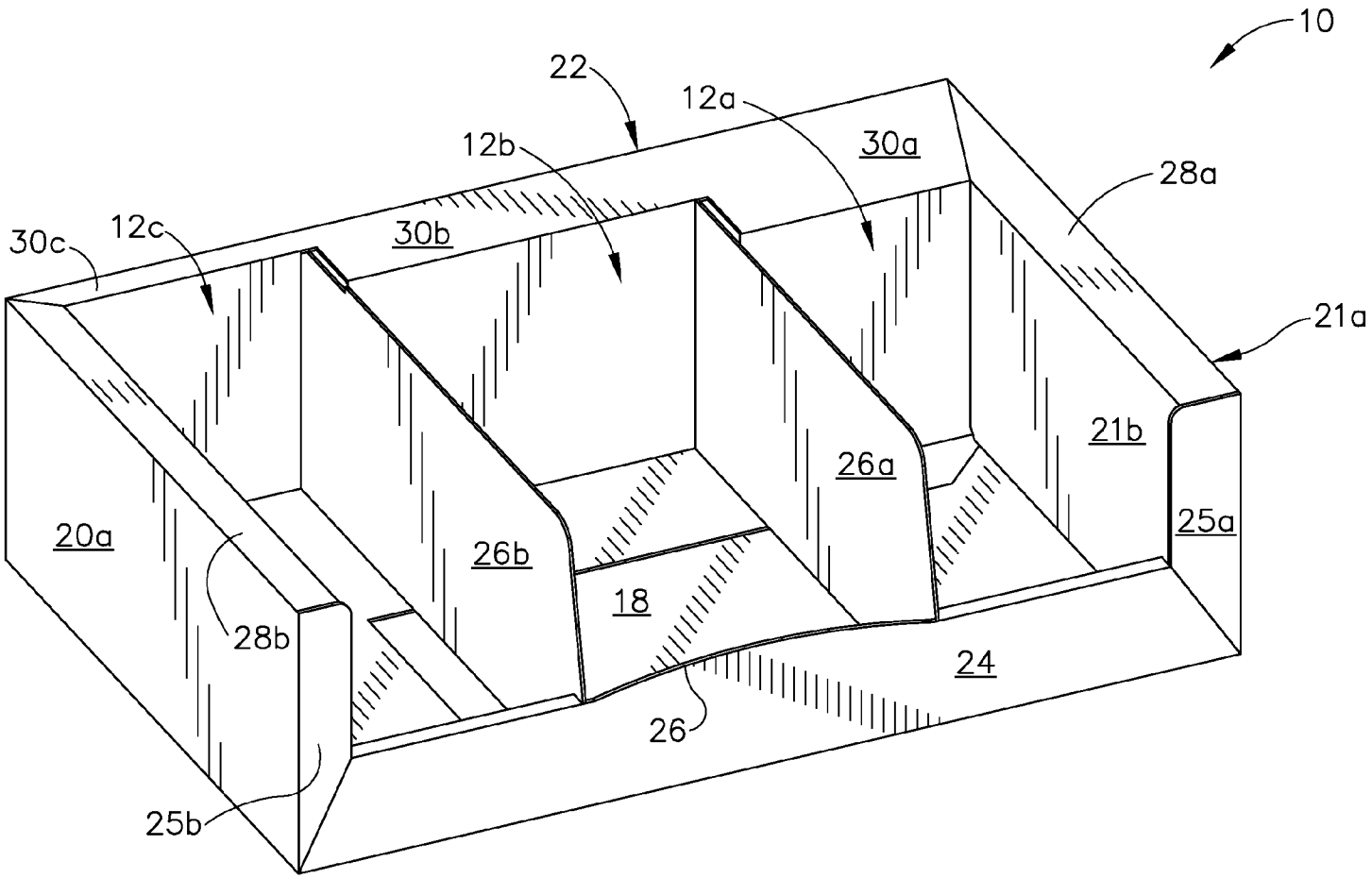
FIG. 4 is a top perspective view of shipping and display tray fully constructed from Blank B shown in FIG. 2.

FIG. 2 is a plan view of a cut and scored paperboard blank B for forming the display tray shown in FIGS. 1 and 4 in accordance to the present invention. The blank B is substantially flat symmetrical with respect to its longitudinal axis thereof. The blank B is preferably an integral piece of a material such as continuous sheet of conventional corrugated cardboard. The blank B is cut along its outer margins to form its specific shape. The blank B is divided into three sections I, II, III by two longitudinal fold lines 32, 34. Section I includes the back wall panel 22' including the adjustable buffers panels 30*a*', 30*b*', and 30*c*', bottom wall panel 18', and front wall panel 24' of the display tray 10 and sections II, III includes the opposed double side walls panels 20*a*, 20*b*; 21*a*, 21*b* and the partitions or dividers 26*a*, 26*b* when the blank B is fully constructed. In the exemplary blank B, it should be noted that the section II, III are substantially similar to one another. Each of the sections II, III is further divided by respective fold lines 36*a*, 36*b*; 38*a*, 38*b*; 40, 42*a*, 42*b*; and 44*a*, 44*b*. The area between fold lines 38*a*, 40 and 38*b*, 40 are used to construct the shoulders 28*a*, 28*b* in FIG. 1, and the areas between 52, 40 and 54, 40 and 56, 40 are used to construct respective adjustable buffers 30*a*', 30*b*', and 30*c*' corresponding to three different sizes of compartments 12*a*, 14*b*, and 12*c* as depicted in FIGS. 1 and 4, when the blank B is fully constructed. The blank B is folded along the longitudinal crease line 40 when the respective glue panels 58, 60, and 62 are glued to the respective panels 66', 18', and 64' by the designated glue areas 68. The pre-glued blank B takes much less space during shipping and transportation and can be easily assembled to construct the display tray 10.

As noted above, section I is characterized by the back wall panel 22' including adjustable buffers 30*a*', 30*b*', 30*c*', bottom wall panel 18', and front wall panel 24'. The back wall panel 22' including adjustable buffers 30*a*', 30*b*', 30*c*', bottom wall panel 18', and the front wall panel 24' are defined by respective fold lines 40, 46 and 48. The glue flap 60 is defined by three crease lines 72*a*, 72*b*, and 72*c*. The respective areas x, y, and z between respective fold lines 52, 54, 56 and the crease lines 72*a*, 72*b*, 72*c* and the respective areas 30*a*', 30*b*', and 30*c*' between respective fold lines 52, 54, 56, and 40 are used to construct the adjustable buffer panels 30*a*, 30*b*, 30*c* when the blank B is constructed. Two slots 73*a*, 73*b* are formed between the adjustable buffer panels 30*a*, 30*b*, and 30*c* which are engaged with the partitions or dividers 26*a*', 26*b*' as will be described in greater detail hereinafter. The front or bumper wall panel 24' foldably extends from the longitudinal edge of the bottom wall panel 18'. The bumper or front wall panel 24' includes two identical foldable space apart end flaps 74*a*', 74*b*' that extend from its longitudinal edge via double fold lines 78*a*, 78*b*. Each of the end flaps 74*a*', 74*b*' includes a locking tab 76*a*', 76*b*' which is used to engage the double side walls 20*a*', 20*b*' and 21*a*', 21*b*' with the back wall panel 22' and the bottom wall panel 18' when the blank B is fully constructed.

Each of sections II and III includes the respective glue panel 58', 62' that define by respective fold line 36*a*, 36*b* and is glued to respective panels 66', 64' when sections II and III are folded along the fold line 40. Each of the respective glue panels 58', 62' and panel 66', 64' includes a respective notch 80*a*', 82*a*' and 80*b*', 82*b*' in which they are aligned with one another when the respective glue panel 58', 62' are glued to the respective panels 66', 64'. Each of the double side walls 20*a*', 21*a*' includes a respective foldable first extensions 84*a*, 84*b* which are used to engage the double side wall panels 20*a*', 20*b*' and 21*a*', 21*b*' with the front wall panel 24' when the blank B is fully constructed. As noted above, each of the respective side wall panel 20*b*', 21*b*' includes a respective front panel 25*a*' and 25*b*', which are defined by respective fold lines 23*a*', 23*b*'. When in folded position, the front panel 25*a*' and 25*b*' embrace the bumper or front wall panel 24' which then forms a front U-shaped for the display tray 10. Each of the partitions or dividers 26*a*', 26*b*' includes a foldable partition or divider flaps 88*a*', 88*b*' defined by fold lines 89*a*', 89*b*'. Each of the respective divider flaps 88*a*', 88*b*' is inserted into the respective slots 73*a*', 73*b*'. In addition, each of the dividers 26*a*', 26*b*' includes a respective second extensions 86*a*', 86*b*' that is engaged with the respective end flaps 74*a*', 74*b*' when they are in the folding position.

Figure 3A:
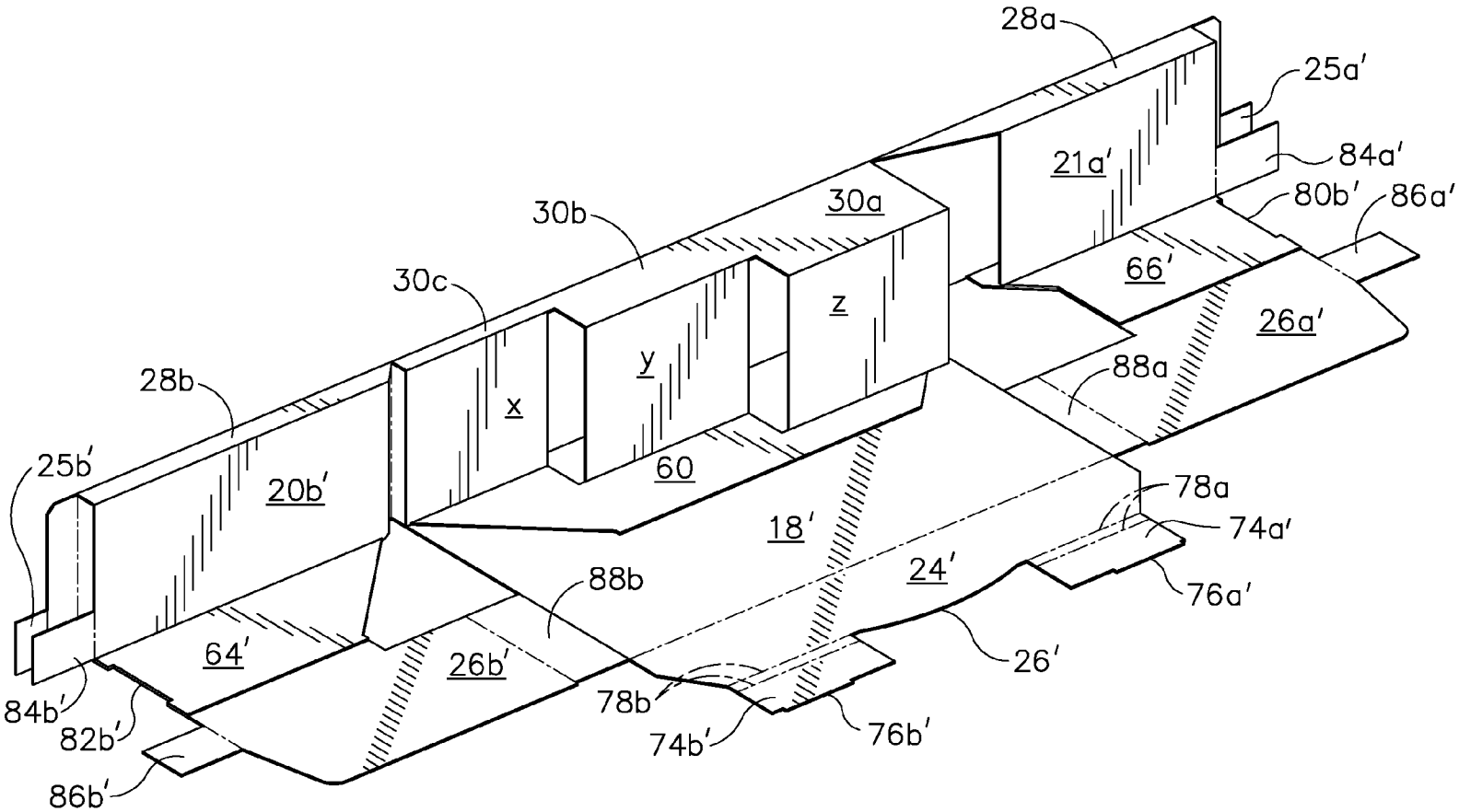
FIGS. 3A and 3B illustrate the folding sequences of the blank B for constructing the display tray shown in FIG. 1 in accordance to the preferred embodiment of the present invention.
Figure 3B:
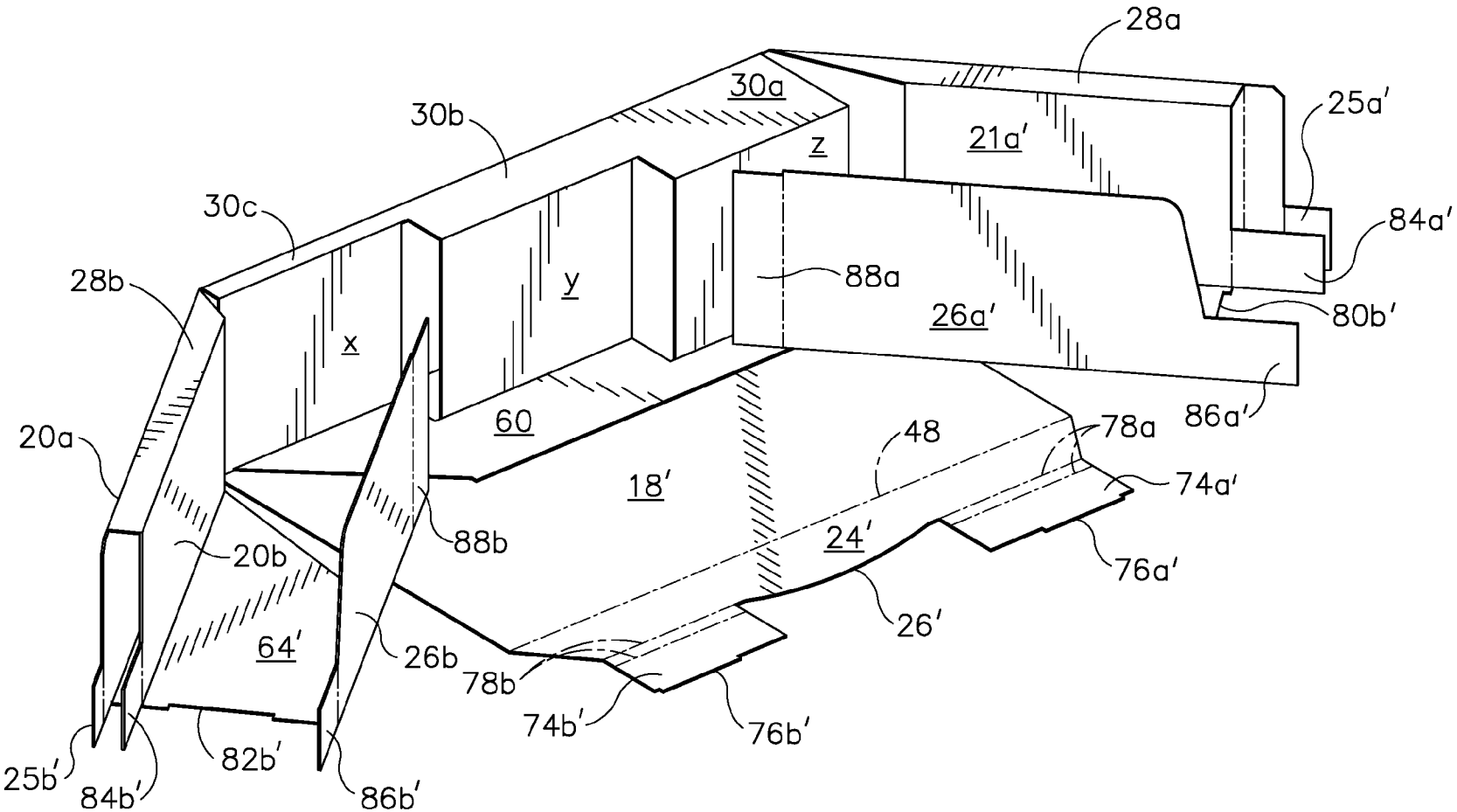

Referring to FIGS. 3A, 3B, and 4, manual set-up of the display tray 10 is easily accomplished. However, a person ordinary skilled in the art would appreciate that generally a folding machine may alternatively perform the forming operations. After die cutting the blank B at the converting plant, a secondary folder/gluer will be used to complete the blank B prior to shipment to a customer. The blank B is laid horizontally and then folded 180 degrees along the fold line 40 so that glue panels 58, 60, and 62 are folded onto and glued to the respective panels 66', 18', and 64' in an overlapping relationships. One side of the blank B is glued to the other side by the glue areas 68 and thus the blank B is pre-glued generally in half. Next, each of the respective panel 64' and panel 66' is folded upwardly at right angle along the respective fold line 42*b*, 42*a* and this action causes each of the respective double side walls 20*a*', 20*b*' and respective double side walls 21*a*', 21*b*' to be in parallel relationship with one another as depicted in FIG. 3A. Next, the respective partitions or dividers 26*a*, 26*b* are folded upwardly at right angle and by holding panel 64' with one hand and panel 66' with other hand, begin to fold the double side walls 20*a*', 20*b*' and 21*a*', 21*b*' via respective fold lines 32, 34 toward the bottom wall 18' and in doing so, the adjustable buffer panels 30*a*, 30*b*, and 30*c* are now constructed. While continue with the folding steps, the respective partitions or dividers flaps 88*a*', 88*b*' is inserted into the respective slots 73*a*', 73*b*'. When the aforementioned steps are completed, the panels 64', 66' are in the horizontal plane resting on top of bottom wall panel 18' and partition panels 26*a*', 26*b*' divide the interior space into three different sizes of compartments 12*a*, 12*b*, and 12*c* as shown in FIG. 4. Next, when the respective first extension 84*a*' and front panel 25*a*' are in overlapping relationship and when the first extension 84*b*' and front panel 25*b*' are in overlapping relationship, they are folded inwardly toward the bottom wall panel 18' while respective second extensions 86*a*, 86*b* are folded outwardly from the bottom wall panel 18' so that in this position, the respective end flaps 74*a*', 74*b*' is rolled over the respective first and second extensions and front panel and finally, the locking tabs 74*a*', 74*b*' are inserted into the respective notches 80 and 82.

The display tray 10 of the present invention is simple and economical in construction, requiring minimal parts and material, and effectively holds three different sizes of compartments 12*a*, 12*b*, and 12*c* loaded with three different products P1, P2, and P3 therein in upright position when displayed for sale.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A shipping and display tray having a bottom wall, a front wall, a back wall, and a respective pair of opposed side walls foldably joined with one another for holding different products contained therein in an upright position at a point of sale, the shipping and display tray comprising:

a one-piece shallow tray comprises a plurality of different sizes of compartments integrally attached to one another and wherein the one-piece shallow tray being divided by a plurality of partitions each of which integrally extends from the respective pair of opposed side walls, the respective plurality of different sizes of compartments includes a respective plurality of buffers that defines the size of the each compartment while maintaining a fixed perimeter or outside dimension of the one-piece shallow tray and wherein each of the respective buffers foldably extends from the back wall and is defined by respective areas x, y, and z configured between respective fold lines (52), (54), (56) and respective crease lines (72*a*), (72*b*), (72*c*) and respective areas (30*a*'), (30*b*'), and (30*c*') configured between the respective fold lines (52), (54), (56), and an additional fold line (40) and wherein the size of each buffer is capable of being changed during manufacture of the shipping and display tray by changing the location of the respective fold lines (52), (54), (56) and wherein the additional fold line (40) separates the back wall from the respective areas (30*a*'), (30*b*'), and (30*c*') and wherein the respective crease lines (72*a*), (72*b*), (72*c*) define a border for a glue flap (60) and the respective areas x, y, and z.

2. The shipping and display tray of claim 1 wherein each of the opposed side walls is defined by two side walls bridging one another.

3. The shipping and display tray of claim 2 wherein each of the two side walls forms a shoulder that permit easy stackability and prevent nesting of display trays onto one another.

4. The shipping and display tray of claim 1 wherein the plurality of partitions include two partitions positioned parallel to one another and having a height that is substantially the same as heights of the opposed side walls.

5. The shipping and display tray of claim 1 wherein the plurality of different sizes of compartments includes three different sizes of compartments.

6. The shipping and display tray of claim 1 wherein the fixed perimeter or outside dimension of the display tray maximizes the cube efficiencies for pallet, truck and shelf fitments.

7. The shipping and display tray of claim 1 wherein the respective plurality of buffers includes three buffers each of which having a different size.

8. The shipping and display tray of claim 1 wherein the display tray is made of corrugated paperboard.

9. A shipping and display tray comprising:

a bottom wall, a front wall, a back wall, and a respective pair of opposed side walls foldably joined with one another to form a one-piece shallow tray having three different sizes of buffers each of which foldably extend from the back wall, two partitions each of which foldably extend from the respective pair of opposed side walls and foldably engaged with the three different sizes of buffers to form three different sizes of compartments while maintaining a fixed perimeter or outside dimension of the one-piece shallow tray and wherein each of the three different sizes of buffers is defined by respective areas x, y, and z configured between respective fold lines (52), (54), (56) and respective crease lines (72*a*), (72*b*), (72*c*) and the respective areas (30*a*'), (30*b*'), and (30*c*') configured between the respective fold lines (52), (54), (56), and an additional fold line (40) and wherein the additional fold line (40) separates the back wall from the respective areas (30*a*'), (30*b*), and (30*c*') and wherein the respective crease lines (72*a*), (72*b*), (72*c*) define a border between a glue flap (60) and the respective areas x, y, and z.

10. The shipping and display tray of claim 9 wherein the fixed perimeter or outside dimension of the display tray maximizes the cube efficiencies for pallet, truck and shelf fitments.

11. A blank (B) for making a shipping and display tray for holding different products contained therein in an upright position at a point of sale, the blank (B) comprising:

three sections I, II, III formed by two longitudinal fold lines (32), (34) wherein section I includes a back wall panel (22') having three buffers panels (30*a*'), (30*b*'), (30*c*'), a bottom wall panel (18'), and a front wall panel (24') of the shipping and display tray (10) and respective sections II and III includes respective double side walls panels (20*a*), (20*b*) and double side walls panels (21*a*), (21*b*) and partitions (26*a*), (26*b*) when the shipping and display tray (10) is fully constructed, each of the respective sections II, III being divided by respective fold lines into respective areas wherein the respective areas between the respective fold lines are used to construct respective shoulders and respective buffers (30*a*'), (30*b*'), and (30*c*') corresponding to three different sizes of compartments when the shipping and display tray (10) is fully constructed.

12. The blank of claim of claim 11 wherein the blank (B) is folded 180 degrees along one of said fold lines so that glue panels (58), (60), (62) are folded onto and glued to respective panels (66'), (18'), (64') in an overlapping relationship.

* * * * *